US005727765A

United States Patent [19]

Alvern

[11] Patent Number: 5,727,765

[45] Date of Patent: Mar. 17, 1998

[54] DEVICE FOR PREVENTING DAMAGE TO A GAS PUMP FILLER GUN

[75] Inventor: Stein Alvern, Oslo, Norway

[73] Assignee: Alvern-Norway A/S, Norway

[21] Appl. No.: 680,986

[22] Filed: Jul. 16, 1996

[51] Int. Cl.[6] ..... A62C 13/76

[52] U.S. Cl. ..... 248/329; 248/75; 248/83; 248/328; 222/529

[58] Field of Search ..... 248/329, 75, 76, 248/80, 82; 242/379, 379.2, 398, 406; 222/529, 530, 14, 27, 52

[56] References Cited

U.S. PATENT DOCUMENTS

| | | | |
|---|---|---|---|
| D. 173,007 | 9/1954 | Anderson . | |
| D. 297,943 | 10/1988 | Mattos . | |
| 980,890 | 1/1911 | Edwards . | |
| 2,176,979 | 10/1939 | Platz | 248/328 |
| 2,719,653 | 10/1955 | Bledsoe | 248/75 X |
| 2,800,931 | 7/1957 | Sutcliffe . | |
| 2,872,142 | 2/1959 | Pottash | 248/80 |
| 2,930,514 | 3/1960 | Pacey | 222/530 |
| 2,986,364 | 5/1961 | Vestal | 248/75 |
| 3,273,800 | 9/1966 | Keys et al. | 248/328 X |
| 3,474,837 | 10/1969 | Carder et al. . | |
| 4,042,184 | 8/1977 | Langenohl | 242/47.5 |
| 4,138,042 | 2/1979 | Okada | 248/75 X |
| 4,238,096 | 12/1980 | Dvorachek | 248/75 |
| 4,360,127 | 11/1982 | Maruyama et al. . | |
| 4,383,252 | 5/1983 | Purcell et al. | 248/75 X |
| 4,465,209 | 8/1984 | Wilder . | |
| 4,576,312 | 3/1986 | Swick, Jr. . | |
| 4,930,665 | 6/1990 | Devine . | |
| 5,163,586 | 11/1992 | Zinsmeyer . | |
| 5,593,116 | 1/1997 | Pettesch et al. | 248/75 |

*Primary Examiner*—Peter M. Cuomo
*Assistant Examiner*—Robert J. Sandy
*Attorney, Agent, or Firm*—Finnegan, Henderson, Farabow, Garrett & Dunner, L.L.P.

[57] ABSTRACT

An apparatus prevents damage to a fuel pump filler gun. An arm pivots above a gas pump. A retractable wire extends from the arm and attaches to the filler gun. The length of the wire is less than the height at which the arm pivots above the ground. If the filler gun is dropped, it will hang suspended from the wire, and will not strike the ground.

9 Claims, 2 Drawing Sheets

DEVICE FOR PREVENTING DAMAGE TO A GAS PUMP FILLER GUN

BACKGROUND OF THE INVENTION

1. Field of the Invention

The present invention relates to an apparatus for preventing damage to a gas pump filler gun. More specifically, the invention relates to an apparatus that will prevent a gas pump filler gun, that is dropped by a user, from striking the ground and being damaged by the impact.

2. Description of the Prior Art

A gas pump filler gun comprises a barrel, extendable into a vehicle fuel tank, a gun head enclosing valve internals, and a handle having a squeezable lever communicating with the valve internals. Gas pump filler gun heads are well-known to vehicle drivers who regularly pump their own gasoline.

A problem occurs because vehicle drivers, prior to or after filling their gas tanks, frequently drop the filler guns. The resultant impact with the ground surface, which is typically made of concrete, can damage the filler gun by bending the barrel, damaging the valve internals, and so on.

Consequently, the oil companies are forced each year to spend millions of dollars maintaining and repairing gas pump filler guns. This maintenance and repair expense translates into higher gasoline prices to consumers.

It is desirable therefore to find ways to prevent damage to the gas pump filler guns.

It would be preferable, obviously, to avoid impact with the ground altogether. One way to achieve this result would be to shorten the length of hose between the pump and the filler gun, so that the gun could not reach the ground if dropped. This method is impractical, however, because drivers park at different distances from the gas pump, and a short hose might be unable to reach the vehicle.

SUMMARY OF THE INVENTION

The present invention avoids the above shortcomings in the related art, and prevents damage to gas pump filler guns resulting from dropping the filler guns.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The present invention, as broadly embodied herein, relates to an apparatus for preventing damage to a gas pump filler gun associated with a gas pump. The apparatus includes a vertical support positioned proximate the gas pump. An arm is pivotally linked to the vertical support, to pivot at a selected height above the ground. A rotatable reel is positioned along the length of the arm. A wire, having two opposite ends, is also provided, the first end being attached to the reel, and the second end being attached to the filler gun. The second end of the wire is retractably extendable away from the reel upon movement of the gas pump handle, e.g., when grasped by a user and pulled away from the pump. The wire has a length between the two ends when it is fully extended that is less than the selected height of the arm above the ground. Preferably, the reel is configured to always maintain the wire taut between the reel and the filler gun.

Accordingly, if the gas pump filler gun is dropped, the wire will extend to its full length, but the filler gun will not hit the ground. Instead, the filler gun will be held above the ground at least by a distance equal to the difference between the selected height at which the arm pivots, and the fully extended length of the wire.

DESCRIPTION OF THE DRAWINGS

The accompanying drawings, which are incorporated in an constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as broadly illustrated in the accompanying drawings.

Figure 1:
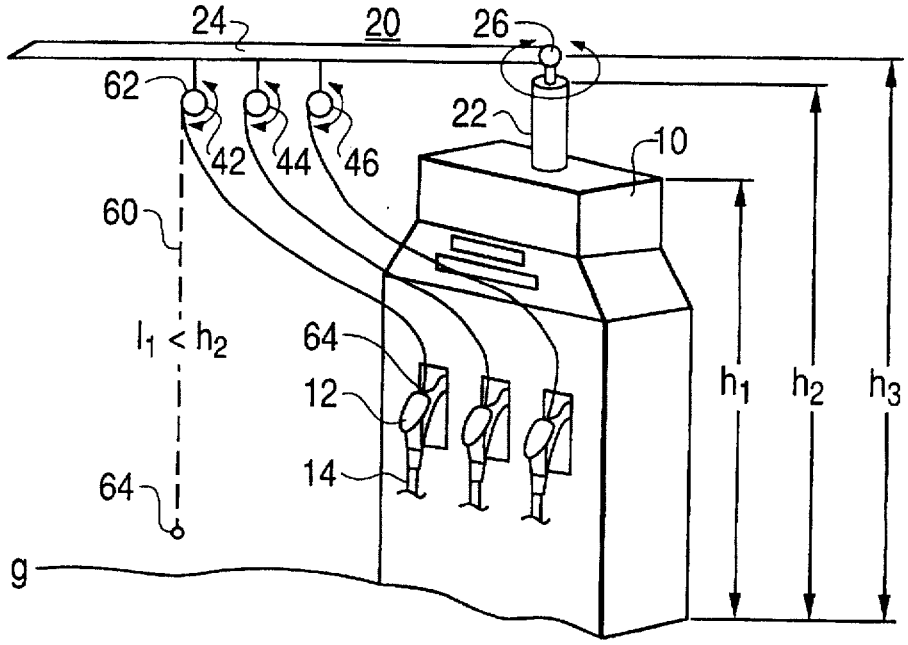
FIG. 1 is a perspective view of a fuel pump and an apparatus for preventing damage to a fuel pump filler gun in accordance with the invention.

Referring to FIG. 1, a gas pump 10 is positioned on surface "g," i.e., at a fuel station. Gas pump 10 typically has a plurality of filler guns 12 and hoses 14, to supply drivers with an option of different octane gasolines or diesel fuel. Each filler gun 12 broadly includes a barrel 16, head position 17, and handle 18. The filler gun 12 can be damaged when it is dropped onto the ground "g".

In accordance with the invention, an apparatus is provided to prevent damage to the filler guns. The apparatus is broadly referred to by reference numeral 20.

In accordance with the invention, a support is positioned proximate the gas pump. As broadly embodied herein, a vertically oriented support 22 may include a vertically oriented bracket. Alternatively, the vertical support may be a portion of the gas station structure itself. For example, many modern gas stations provide an overhead structure above the gas pumps to protect users from the elements. Such an overhead structure itself may be used to form the vertical support for the invention.

As broadly depicted in FIG. 1, support 22 has a height $h_2$ that is greater than a height $h_1$ of the gas pump 10. It is presently preferred that the vertical support act to support the apparatus 20 at a height greater than that of the gas pump. However, this is not absolutely required, as will be discussed in greater detail below.

In accordance with the invention, an arm is pivotally linked to the support, to pivot at a selected height above the ground. As broadly embodied herein, and referring to FIG. 1, an arm 24 is pivotally linked with a conventional pivotable ball and socket joint 26 to support 22. The arm 24 preferably pivots in a plane parallel to surface "g". This plane is at height $h_3$ (which may be equal to, greater than, or less than $h_2$) above surface "g".

Figure 4:
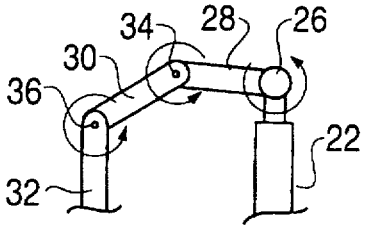
FIG. 4 depicts an alternate configuration for the pivotal arm.
Figure 5:
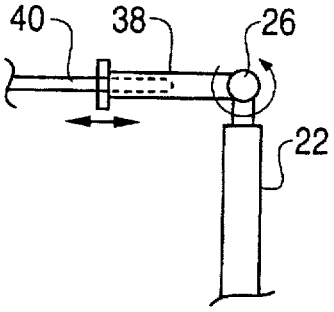
FIG. 5 depicts another alternate configuration for the pivotal arm.
Figure 6:
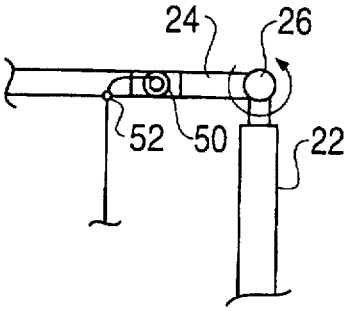
FIG. 6 depicts an alternate configuration for the reel.

Arm 24 can have a variety of shapes and configurations. As broadly embodied in FIGS. 1–3, arm 24 comprises a single elongated element extending away from pivot position 26. However, as broadly embodied in FIG. 4, arm 24 may have a plurality of links 28, 30, 32, which also may be pivotally connected at pivot points 26, 34, 36 as desired, in order to provide greater flexibility to the arm. Alternatively, for ease of a driver parking far away from a gas pump, arm 24 may include a first portion 38 and a telescoping second portion 40, as broadly depicted in FIG. 5.

In accordance with the invention, a rotatable reel is positioned along the length of the arm. As broadly embodied in FIGS. 1–3, a series of rotatable wire reels 42, 44, 46 are suspended rotatably from brackets attached to arm 24. In the preferred embodiment, one reel is provided for each filler gun. However, for ease of discussion, only a single reel 42 will be referred to hereafter.

Figure 2:
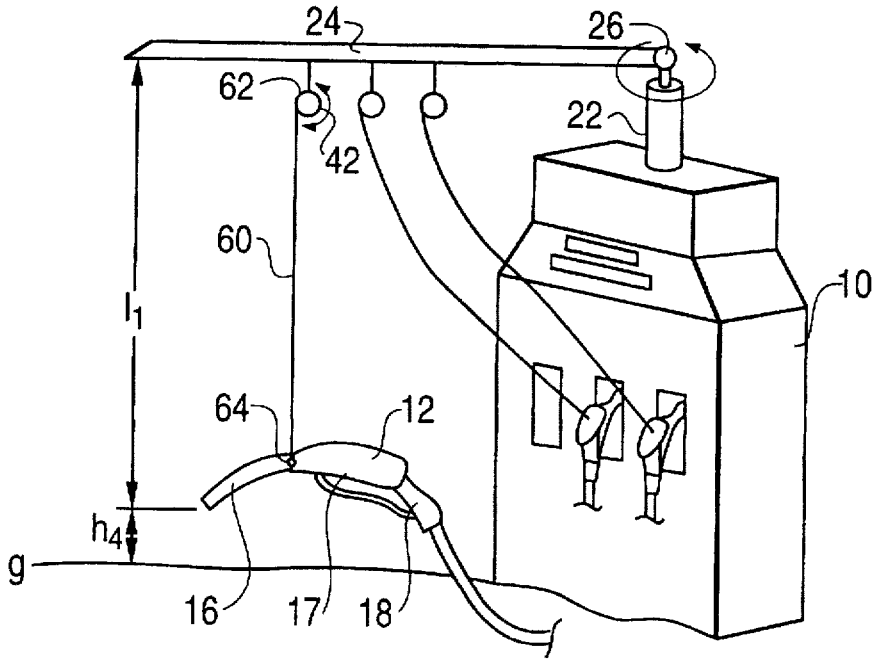
FIG. 2 is a perspective view depicting operation of the apparatus depicted in FIG. 1.
Figure 3:
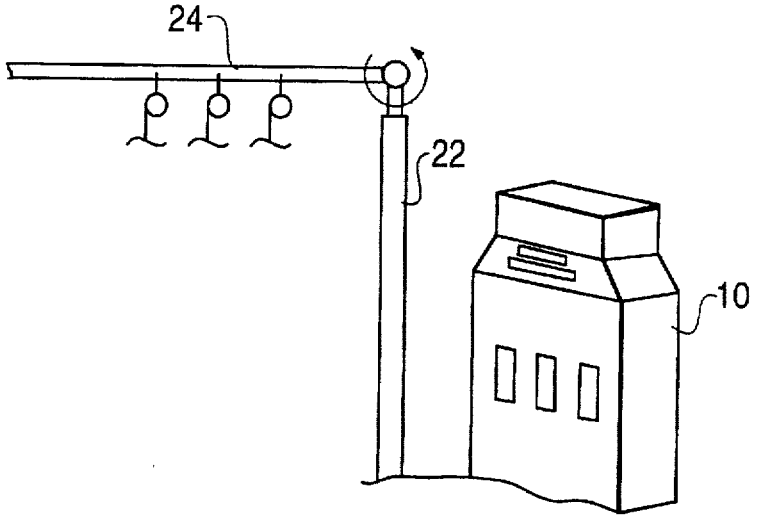
FIG. 3 depicts an alternate position for the vertical support.
Figure 7:
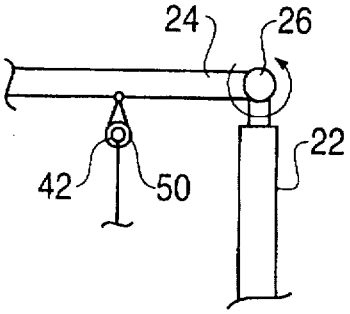
FIG. 7 depicts another alternate configuration for the reel.
Figure 8:
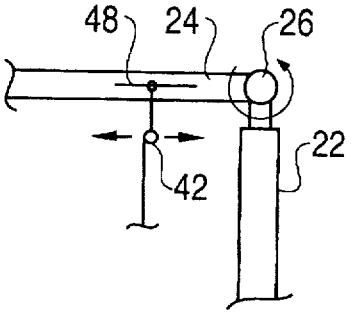
FIG. 8 depicts another alternate configuration for the reel.

The reel 42 can be positioned in a variety of positions and configurations. In the drawings, the reel 42 is provided midway along the length of arm 24. However, reel 42 may also be positioned anywhere along the length, or at the distal end of the arm 24. Alternatively, reel 42 can be provided in a track 48 in arm 24 to extend to a selected position along the length thereof, as broadly depicted in FIG. 8. Likewise, reel 42 may be suspended external to the arm 24, as shown in FIGS. 1–3, or it may be positioned in a cavity 50 internal to the arm 24. In this configuration, an orifice 52 must be provided in the arm 24. In another embodiment, shown broadly in FIG. 7, reel 42 is provided to pivot in a bell-shaped case 54 suspended pivotally from arm 24.

In accordance with the invention, a wire having two opposite ends is provided, the first end attached to the reel and the second end being attachable to the filler gun, the second end of the wire being retractably extendable away from the reel upon movement of the filler gun, the wire having a length between the two ends when fully extended that is less than the selected height at which the arm pivots above the ground. As broadly embodied herein, and referring to FIGS. 1 and 2, a wire 60 has two ends 62 and 64. (For ease of discussion, only one wire, associated with one reel 42 and one filler gun, will be discussed.) First end 62 is attached to reel 42. Second end 64 is attached to filler gun 12, preferably proximate the junction between barrel 16 and head 17. A variety of connecting methods may be used to attach wire end 64 to filler gun 12.

The second end 64 of wire 60 extends away from reel 42, with reel 42 rotating in a first "extend" direction (away from the arm 24), as the user grasps filler gun 12 and carries it away from gas pump 10 to fuel his or her vehicle. The reel preferably is spring loaded to rotate in a second "retract" direction, attempting to draw second end 64 of wire 60 back toward arm 24 when the user stops pulling the filler gun away from the gas pump. The amount of spring tension in reel 42 should be selected so that wire 60 preferably remains generally taut at all times, but does not inhibit or hinder the user from pulling the filler gun and hose away from the gas pump toward his or her vehicle.

Referring to FIG. 1, the fully extended length $l_1$ of wire 60 is shown in relief. As can be seen, fully extended wire length $l_1$ is less than the height $h_3$ at which arm 24 pivots above the ground. Hence, even at its full extent, the second end 64 of wire 60 can never reach ground "g".

It will be readily apparent that, for this reason, if the gas pump user drops filler gun 12, it will not strike the ground. At the worst case, it will hang suspended at a height $h_4$ above the ground. Height $h_4$ generally equals the difference between $h_3$ and $l_1$. Accordingly, when the height of $l_1$ is selected, consideration of the length of the filler gun itself must be taken into consideration to ensure the filler gun does not strike the ground.

It is presently preferred that wire 60 be a metal wire to prevent breaking or stretching. However, other materials also may be used, if they are not inclined to stretch or break.

Also, as long as $l_1$ is selected to be less than preventing the filler gun from striking the ground, it will be apparent that the height $h_2$ of support 22 can vary. However, it is perceived that placing the arm 24 above the pump 10 will be the easiest and most convenient configuration.

Additional advantages and modifications will readily occur to those skilled in the art. The invention in its broader aspects is, therefore, not limited to the specific details and representative apparatus shown and described. Accordingly, departures may be made from such details without departing from the spirit or scope of applicant's general inventive concept.

What is claimed is:

1. An apparatus for preventing damage to a gas pump filler gun associated with a gas pump, comprising:

a support positioned proximate the gas pump;

an arm pivotally linked to said support, to pivot at a selected height above the ground;

a rotatable reel positioned along the length of the arm; and a wire having two opposite ends, the first end attached to said reel and the second end attachable to the gas pump filler gun, the second end of said wire being retractably extendable away from said reel upon movement of the gas pump filler gun, said wire having a length between the two ends when fully extended that is less than said selected height.

2. The apparatus of claim 1, wherein said reel is configured to maintain the wire taut between the reel and the gas pump handle.

3. The apparatus of claim 1, wherein said arm is pivotally attached to said support above the gas pump.

4. The apparatus of claim 1, wherein said arm is pivotally attached to said support alongside the gas pump.

5. The apparatus of claim 1, wherein said arm has a plurality of pivotally connected links.

6. The apparatus of claim 1, wherein said arm is configured to be extendable in length.

7. The apparatus of claim 1, wherein said reel is positioned external to said arm.

8. The apparatus of claim 1, wherein said reel is positioned internal to said arm.

9. The apparatus of claim 1, wherein said reel is positioned in a case pivotally attached to said arm.

* * * * *